US011053959B2

(12) United States Patent
Kanna

(10) Patent No.: US 11,053,959 B2
(45) Date of Patent: Jul. 6, 2021

(54) HYDRAULIC DRIVE APPARATUS FOR INDUSTRIAL VEHICLE

(71) Applicant: KABUSHIKI KAISHA TOYOTA JIDOSHOKKI, Kariya (JP)

(72) Inventor: Takanori Kanna, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 16/831,089

(22) Filed: Mar. 26, 2020

(65) Prior Publication Data

US 2020/0318659 A1 Oct. 8, 2020

(30) Foreign Application Priority Data

Apr. 4, 2019 (JP) ..... JP2019-071812

(51) Int. Cl.
*F15B 15/02* (2006.01)
*F15B 11/04* (2006.01)
*B66F 9/22* (2006.01)

(52) U.S. Cl.
CPC ..... *F15B 15/02* (2013.01); *F15B 11/04* (2013.01); *B66F 9/22* (2013.01); *F15B 2211/505* (2013.01); *F15B 2211/75* (2013.01)

(58) Field of Classification Search
CPC .... F15B 15/02; F15B 11/04; F15B 2211/505; F15B 2211/75; B66F 9/22
See application file for complete search history.

(56) References Cited

U.S. PATENT DOCUMENTS 6,439,102 B1 * 8/2002 Matsuzaki ..... B66F 9/22 91/445
9,469,515 B2 * 10/2016 Matsuo ..... F15B 13/02
9,631,613 B2 * 4/2017 Ueda ..... F15B 21/14
9,771,250 B2 * 9/2017 Ueda ..... F15B 11/0423
9,957,982 B2 * 5/2018 Ueda ..... B66F 9/22

FOREIGN PATENT DOCUMENTS

JP 2002-104796 A 4/2002
JP 2002-193598 A 7/2002
JP 2007-039226 A 2/2007
JP 2007-055754 A 3/2007
JP 2015-040081 A 3/2015

OTHER PUBLICATIONS

Communication dated Aug. 25, 2020 by the European Patent Application No. 20167136.9.

* cited by examiner

*Primary Examiner* — Abiy Teka
(74) *Attorney, Agent, or Firm* — Sughrue Mion, PLLC

(57) ABSTRACT

A hydraulic drive apparatus for an industrial vehicle includes a cargo-handling device, a hydraulic control device, a cargo-handling-device operating member, and a switching member. When a first operation of the cargo-handling-device operating member is performed, an open-close valve is opened to hydraulic oil flowing in a first direction to cause the hydraulic oil to bypass a throttle. When a second operation of the cargo-handling-device operating member is performed while the switching member is in a first state, the open-close valve is closed against hydraulic oil flowing in a second direction to cause the hydraulic oil to flow through the throttle. The throttle provided in a flow route of the hydraulic oil between a main control valve and the cargo-handling device reduces a flow rate of the hydraulic oil to restrict cargo handling.

4 Claims, 6 Drawing Sheets

HYDRAULIC DRIVE APPARATUS FOR INDUSTRIAL VEHICLE

CROSS-REFERENCE TO RELATED APPLICATION

This application claims priority to Japanese Patent Application No. 2019-071812 filed on Apr. 4, 2019, the entire disclosure of which is incorporated herein by reference.

BACKGROUND ART

The present disclosure relates to a hydraulic drive apparatus for an industrial vehicle.

An example of a conventional hydraulic drive apparatus for an industrial vehicle is disclosed in Japanese Patent Application Publication No. 2015-040081.

The above conventional hydraulic drive apparatus includes an interlocking mechanism that restricts an operation of a cargo-handling device by locking a spool when a seat switch is off. In the above conventional hydraulic drive apparatus, the spool is locked when the seat switch is off, and the spool is unlocked when the seat switch is on.

According to Japanese Patent Application Publication No. 2015-040081, an interlocking feature is provided for cargo handling performed by any operations of a cargo-handling-device operating member. In contrast to this, it is required to provide an interlocking feature for cargo handling performed by only one of operations of a cargo-handling-device operating member. As an example of a hydraulic drive apparatus having such an interlocking feature that is provided for cargo handling performed by only one of operations of the cargo-handling-device operating member, the hydraulic drive apparatus may have a configuration in which the cargo handling is not allowed by the one of the operations unless a switch is turned on, but is allowed by the other of the operations regardless of the switching status. In this configuration, if the switch is always kept on by some measure, the cargo handling is allowed by the one of the operations of the cargo-handling-device operating member because the interlocking is released, and the cargo handling is also allowed by the other of the operations of the cargo-handling-device operating member without a restriction. The driver may keep the switch on all the time by some measure to save the trouble to turn on and off the switch. As a result, substantially no interlocking feature is provided, that is, interlocking does not function effectively. To stop the driver keeping the switch on all the time, a restriction may be placed on the cargo handling performed by the other of operations of the cargo-handling-device operating member while the switch is on. What is required is an interlocking feature that restricts cargo handling performed by the other of operations of a cargo-handling-device operating member while a switching member (switch) is turned to an interlock releasing side.

The present disclosure is directed to providing a hydraulic drive apparatus for an industrial vehicle in which an interlocking feature is provided for cargo handling performed by one of operations of a cargo-handling-device operating member, and also, when a switching member is turned to an interlock releasing side, a restriction is placed on the cargo handling performed by the other of the operations of the cargo-handling-device operating member.

SUMMARY

In accordance with an aspect of the present disclosure, there is provided a hydraulic drive apparatus for an industrial vehicle. The hydraulic drive apparatus driven by a pressure of hydraulic oil supplied from a hydraulic pump includes a cargo-handling device that handles an object, a hydraulic control device that controls the pressure of the hydraulic oil supplied to the cargo-handling device, a cargo-handling-device operating member that is used to operate the cargo-handling device, and a switching member that switches operations of the cargo-handling device. The hydraulic control device includes a main control valve that switches connection states in a flow route according to an operation of the cargo-handling-device operating member, a lock valve that is provided in a part of the flow route of the hydraulic oil between the main control valve and the cargo-handling device and is opened and closed by the switching member, a throttle that is provided in the part of the flow route of the hydraulic oil between the main control valve and the cargo-handling device and reduces a flow rate of the hydraulic oil, and an open-close valve provided to cause the hydraulic oil to bypass the lock valve and the throttle. The hydraulic oil flows in a first direction when a first operation of the cargo-handling-device operating member is performed, and the hydraulic oil flows in a second direction when a second operation of the cargo-handling-device operating member is performed. When the switching member is in a first state, the lock valve is opened, the open-close valve is opened to the flow of the hydraulic oil in the first direction to cause the hydraulic oil to bypass the throttle, and the open-close valve is closed against the flow of the hydraulic oil in the second direction to cause the hydraulic oil to flow through the throttle.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which:

FIG. 3 is a diagram showing an operation of the hydraulic drive apparatus when the lever is pushed while the switch is on;

FIG. 5 is a diagram showing an operation of the hydraulic drive apparatus when the lever is pulled while the switch is on.

DETAILED DESCRIPTION OF THE EMBODIMENTS

Figure 1:
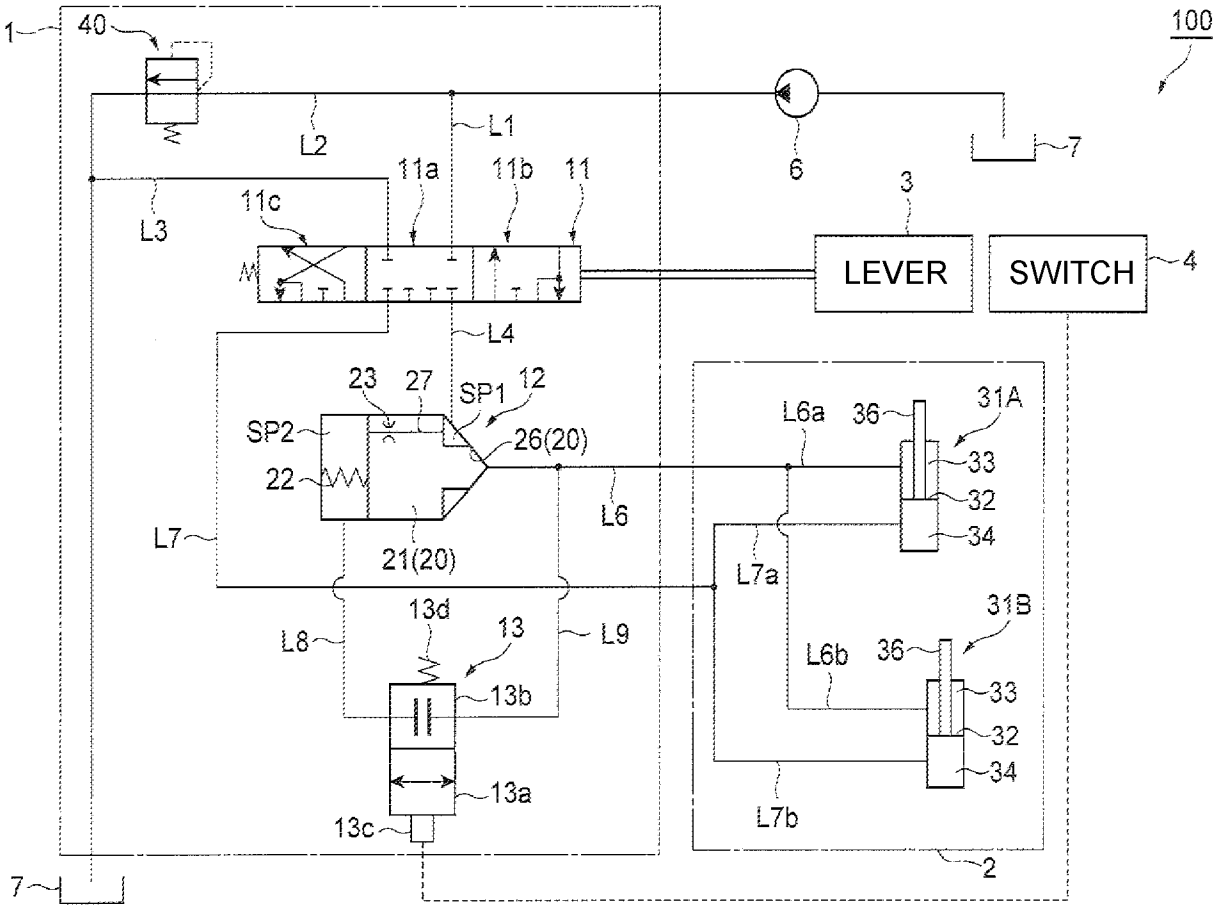
FIG. 1 is a schematic diagram showing a hydraulic drive apparatus for an industrial vehicle according to an embodiment of the present disclosure.

The following will describe an embodiment according to the present disclosure in detail with reference to the accompanying drawings. In the drawings, the same or equivalent elements are denoted by the same reference numerals, and redundant description is omitted.

FIG. 1 is a schematic diagram showing a hydraulic drive apparatus for an industrial vehicle according to the embodiment of the present disclosure. A hydraulic drive apparatus 100 according to the present embodiment performs cargo handling by holding a cargo with a pair of holding members. Examples of such an industrial vehicle that handles the cargo include a forklift equipped with a clamping attachment. The hydraulic drive apparatus 100 provides an interlocking feature for the cargo handling performed by opening the pair of the holding members.

The hydraulic drive apparatus 100 is driven by a pressure of hydraulic oil supplied from a hydraulic pump 6. As shown in FIG. 1, the hydraulic drive apparatus 100 includes a hydraulic control device 1, a cargo-handling device 2, a lever 3 (cargo-handling-device operating member), a switch 4 (switching member), and the hydraulic pump 6. It is noted that FIG. 1 shows only components that are related to the characteristic operations of the hydraulic drive apparatus 100 of the present embodiment, but omits other components as appropriate.

The hydraulic control device 1 controls the pressure of hydraulic oil supplied to the cargo-handling device 2. The hydraulic control device 1 includes a main control valve 11, a logic valve 12, and a lock valve 13. The hydraulic control device 1 also includes a flow route through which hydraulic oil flows.

The hydraulic control device 1 includes lines L1 to L9 as the flow route through which the hydraulic oil flows. The line L1 connects the hydraulic pump 6 and the main control valve 11. The line L2 connects the line L1 and a tank 7. The line L3 connects the line L2 and the main control valve 11. The line L4 connects the main control valve 11 and the logic valve 12. The line L6 connects the logic valve 12 and the cargo-handling device 2. The line L7 connects the main control valve 11 and the cargo-handling device 2. The line L8 connects the logic valve 12 and the lock valve 13. The line L9 connects the line L6 and the lock valve 13. A relief valve 40 is provided in the line L2. The relief valve 40 reduces a pressure of the hydraulic oil from the hydraulic pump 6 down to a relief pressure, and the hydraulic oil having the relief pressure is supplied to the cargo-handling device 2.

The main control valve 11 switches the connection states between the lines L1, L3 and the lines L4, L7, according to an operation of the lever 3.

The main control valve 11 includes a first position 11*a* in which the main control valve 11 is set when the lever 3 is in a neutral position (the position when operation is not performed), a second position 11*b* in which the main control valve 11 is set when the lever 3 is pushed, and a third position 11*c* in which the main control valve 11 is set when the lever 3 is pulled. When the main control valve 11 is set in the first position 11*a*, the lines L1 and L3 are blocked from the lines L4 and L7. When the main control valve 11 is set in the second position 11*b*, the line L1 is connected with the line L4 and the line L3 is connected with the line L7. The hydraulic oil is allowed to flow from the line L1 to the line L4, but not allowed to flow from the line L4 to the line L1. The hydraulic oil is allowed to flow from the line L7 to the line L3, but not allowed to flow from the line L3 to the line L7. When the main control valve 11 is set in the third position 11*c*, the line L1 is connected with the line L7 and the line L3 is connected with the line L4. The hydraulic oil is allowed to flow from the line L1 to the line L7, but not allowed to flow from the line L7 to the line L1. The hydraulic oil is allowed to flow from the line L4 to the line L3, but not allowed to flow from the line L3 to the line L4.

The logic valve 12 includes a poppet 21 and a spring 22. The poppet 21 is movably accommodated in an accommodating portion 26. The spring 22 applies an elastic force to the poppet 21 such that the poppet 21 is pressed against one end of the accommodating portion 26. FIG. 1 shows a state where the poppet 21 is closed. In the state where the poppet 21 is closed, the poppet 21 is pressed against the one end of the accommodating portion 26. The poppet 21 blocks the line L6 that is connected to the one end of the accommodating portion 26. A communicating chamber SP1 is formed between a tip end of the poppet 21 and the one end of the accommodating portion 26. The line L4 is connected to the communicating chamber SP1. A spring chamber SP2 is formed between a base end of the poppet 21 and the other end of the accommodating portion 26. The spring 22 is disposed in the spring chamber SP2. A flow passage 27 is formed in the poppet 21 to communicate the communicating chamber SP1 and the spring chamber SP2. A throttle 23 that reduces the flow of the hydraulic oil is formed in the flow passage 27.

The throttle 23 is provided in a part of the flow route of the hydraulic oil between the main control valve 11 and the cargo-handling device 2, and reduces the flow rate of the hydraulic oil. The part of the flow route between the main control valve 11 and the cargo-handling device 2 here corresponds to the line L4, the flow passage 27, the line L8, the line L9 and the line L6.

The poppet 21 and the accommodating portion 26 function as an open-close valve 20 provided to cause the hydraulic oil to bypass the throttle 23 and the lock valve 13. When the poppet 21 is pressed against the one end of the accommodating portion 26, the poppet 21 blocks the line L6, and the communicating chamber SP1 is shut off from the line L6. (See FIGS. 1, 2, and 5.) This is a state in which the open-close valve 20 is closed. When the poppet 21 moves away from the one end of the accommodating portion 26, the communicating chamber SP1 communicates with the line L6. (See FIGS. 3 and 4.) This is a state in which the open-close valve 20 is opened. When the open-close valve 20 is opened, the line L4 communicates with L6 via the communicating chamber SP1. The open-close valve 20 is provided to cause the hydraulic oil to bypass the flow passage 27, the throttle 23, the line L8, the lock valve 13, and the L9.

The lock valve 13 is provided in the part of the flow route of the hydraulic oil between the main control valve 11 and the cargo-handling device 2. The part of the flow route between the main control valve 11 and the cargo-handling device 2 here corresponds to the line L4, the flow passage 27, the line L8, the line L9 and the line L6. The lock valve 13 is opened and closed by the switch 4. The lines L8 and L9 are connected to each other through the lock valve 13. The lock valve 13 switches between connection and disconnection of the lines L8 and L9 according to the on-off state of the switch 4. The lock valve 13 includes a first position 13*a* in which the lock valve 13 is set when the switch 4 is on, and a second position 13*b* in which the lock valve 13 is set when the switch 4 is off. When the lock valve 13 is set in the first position 13*a*, the lines L8 and L9 are connected. This allows the hydraulic oil to flow from the line L8 to the line L9, and also allows the hydraulic oil to flow from the line L9 to the line L8. This is a state in which the lock valve 13 is opened. When the lock valve 13 is set in the second position 13*b*, the lines L8 and L9 connected to each other through the lock valve 13 are disconnected. The lock valve 13 includes a solenoid 13*c* and a spring 13*d*. When the solenoid 13*c* is not activated, the spring 13*d* applies the elastic force to the lock valve 13 such that the lock valve 13 is set in the second position 13*b* and the lock valve 13 is closed. The solenoid 13*c* is activated to generate an attraction force when the switch 4 is on. When the attraction force of the solenoid 13*c* is greater than the elastic force of the spring 13*d*, the lock valve 13 is set in the first position 13*a* and the lock valve 13 is opened.

The cargo-handling device 2 handles a cargo (an object). The cargo-handling device 2 has a pair of cylinders 31A and 31B. Each of the cylinders 31A and 31B is divided into a hydraulic pressure chamber 33 and a hydraulic pressure chamber 34 by a piston 32. Each of the cylinders 31A and 31B has a rod 36 that extends from the piston 32 through to the outside of the hydraulic pressure chamber 33. A cargo-handling member such as a claw is provided to each tip end of the rods 36. A branch line L6*a* branched off from the line L6 is connected to the hydraulic pressure chamber 33 of the cylinder 31A. A branch line L6*b* branched off from the line L6 is connected to the hydraulic pressure chamber 33 of the cylinder 31B. A branch line L7*a* branched off from the line L7 is connected to the hydraulic pressure chamber 34 of the cylinder 31A. A branch line L7*b* branched off from the line L7 is connected to the hydraulic pressure chamber 34 of the cylinder 31B. The rods 36 are pushed out when the hydraulic oil is supplied to the hydraulic pressure chambers 34 of the cylinders 31A and 31B and discharged from the hydraulic pressure chambers 33 of the cylinders 31A and 31B. At this time, the cargo-handling device 2 moves the cargo-handling members in a direction that the cargo-handling members hold the cargo. The rods 36 are drawn in when the hydraulic oil is supplied to the hydraulic pressure chambers 33 of the cylinders 31A and 31B and discharged from the hydraulic pressure chambers 34 of the cylinders 31A and 31B. At this time, the cargo-handling device 2 moves the cargo-handling members in a direction that the cargo-handling members open to release the cargo.

The lever 3 is provided at the driver's seat. The lever 3 is a member that the driver inputs the cargo-handling operation to the cargo-handling device 2. In other words, the lever 3 is used to operate the cargo-handling device 2. The lever 3 is mechanically connected to the main control valve 11, and switches the main control valve 11 depending on the driver's operation. When the lever 3 is pushed, the cargo-handling device 2 moves the cargo-handling members in a direction that the cargo-handling members are away from the cargo. When the lever 3 is pulled, the cargo-handling device 2 moves the cargo-handling members in a direction that the cargo-handling members hold the cargo.

The switch 4 is provided at the driver's seat and switches the operation of the cargo-handling device 2. The switch 4 functions as a switch for interlocking. When the lever 3 is pushed while the switch 4 is on, the cargo-handling device 2 moves the cargo-handling members in the direction that the cargo-handling members are away from the cargo. While the switch 4 is off, even when the lever 3 is pushed, the above operation is restricted. When the lever 3 is pulled while the switch 4 is off, the cargo-handling device 2 moves the cargo-handling members in the direction that the cargo-handling members hold the cargo, without a restriction on the cargo handling operation. When the lever 3 is pulled while the switch 4 is on, the cargo-handling device 2 moves the cargo-handling members in the direction that the cargo-handling members hold the cargo, with a restriction on the cargo-handling operating speed.

The hydraulic pump 6 pumps the hydraulic oil from the tank 7 and supplies the hydraulic oil to the hydraulic control device 1 through the line L1. The hydraulic pump 6 may be driven by an electric motor or an engine.

Figure 2:
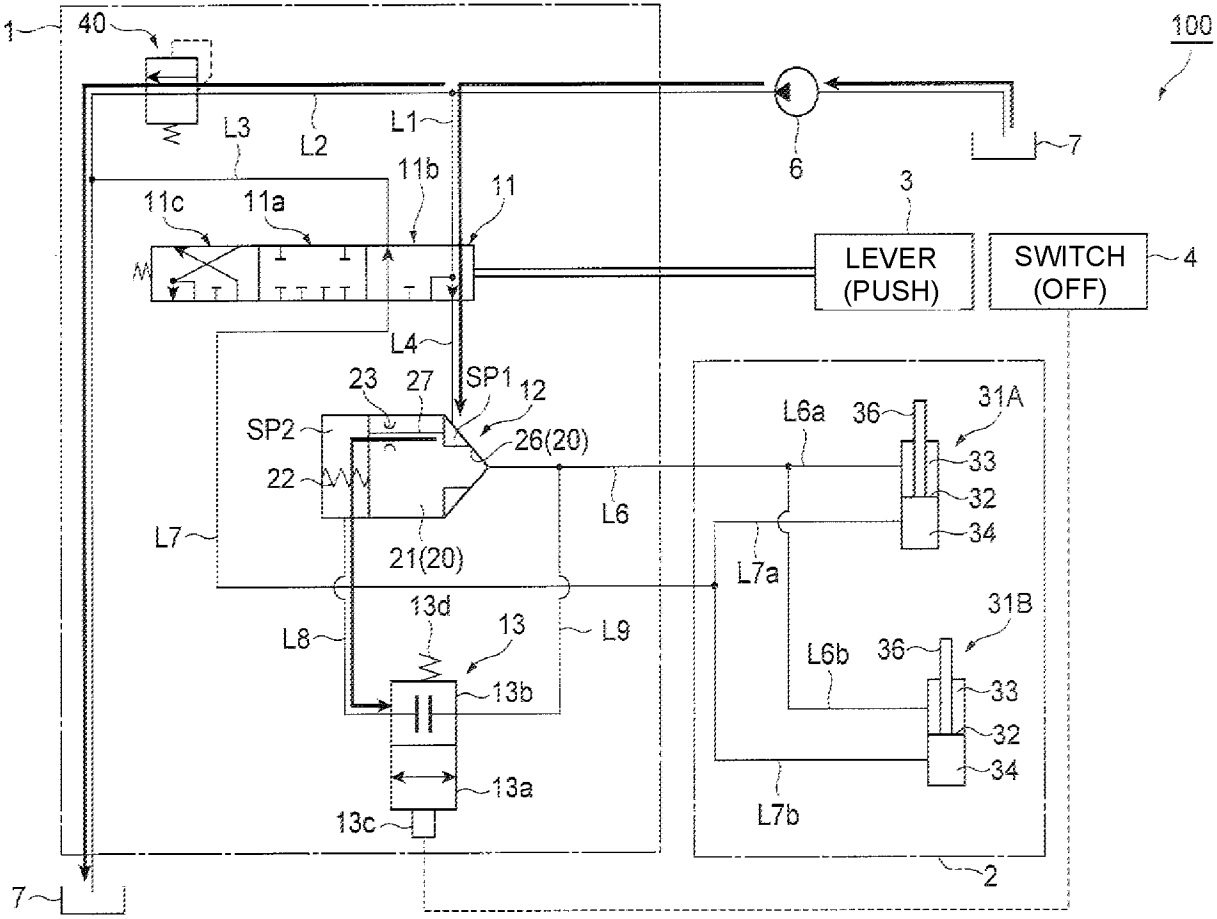
FIG. 2 is a diagram showing an operation of the hydraulic drive apparatus when a lever is pushed while a switch is off.
Figure 3:
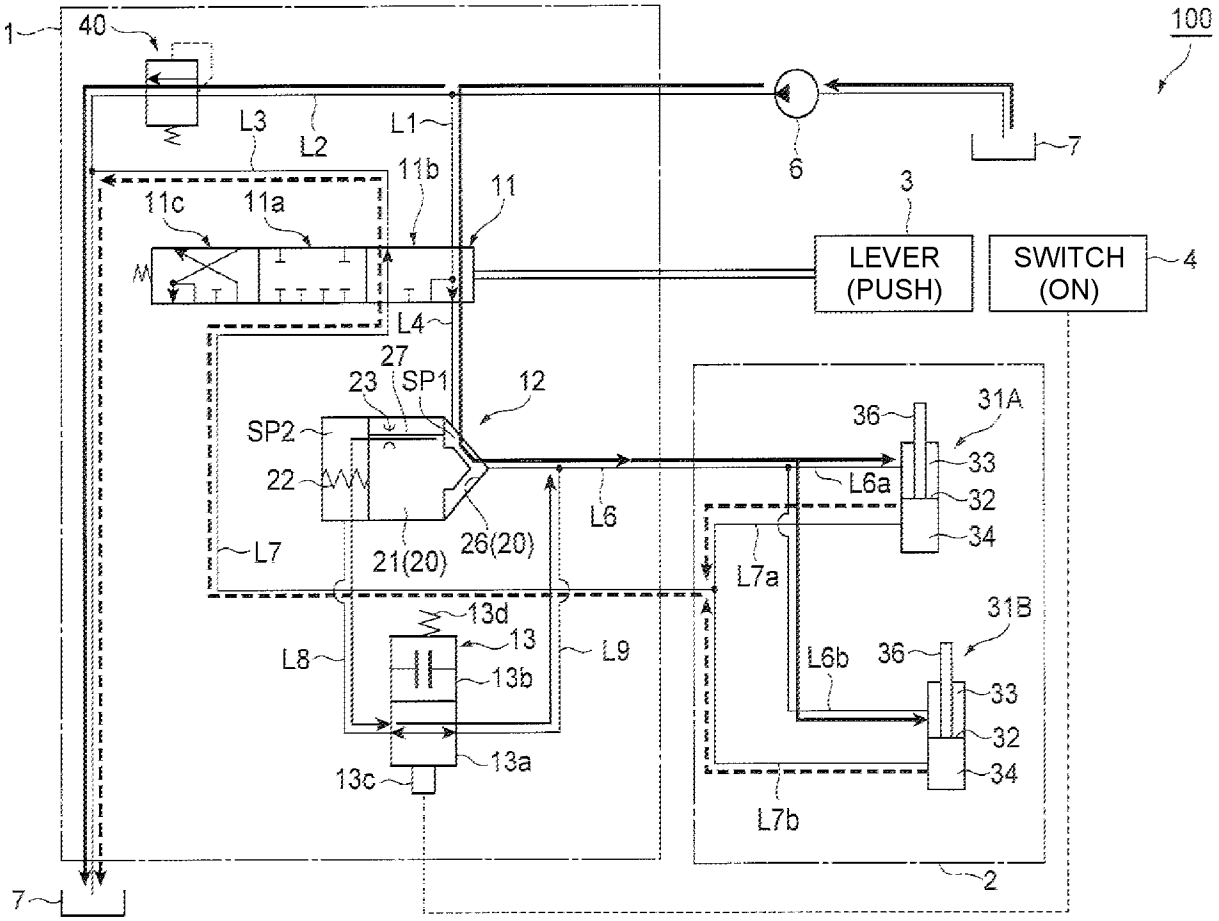
Figure 4:
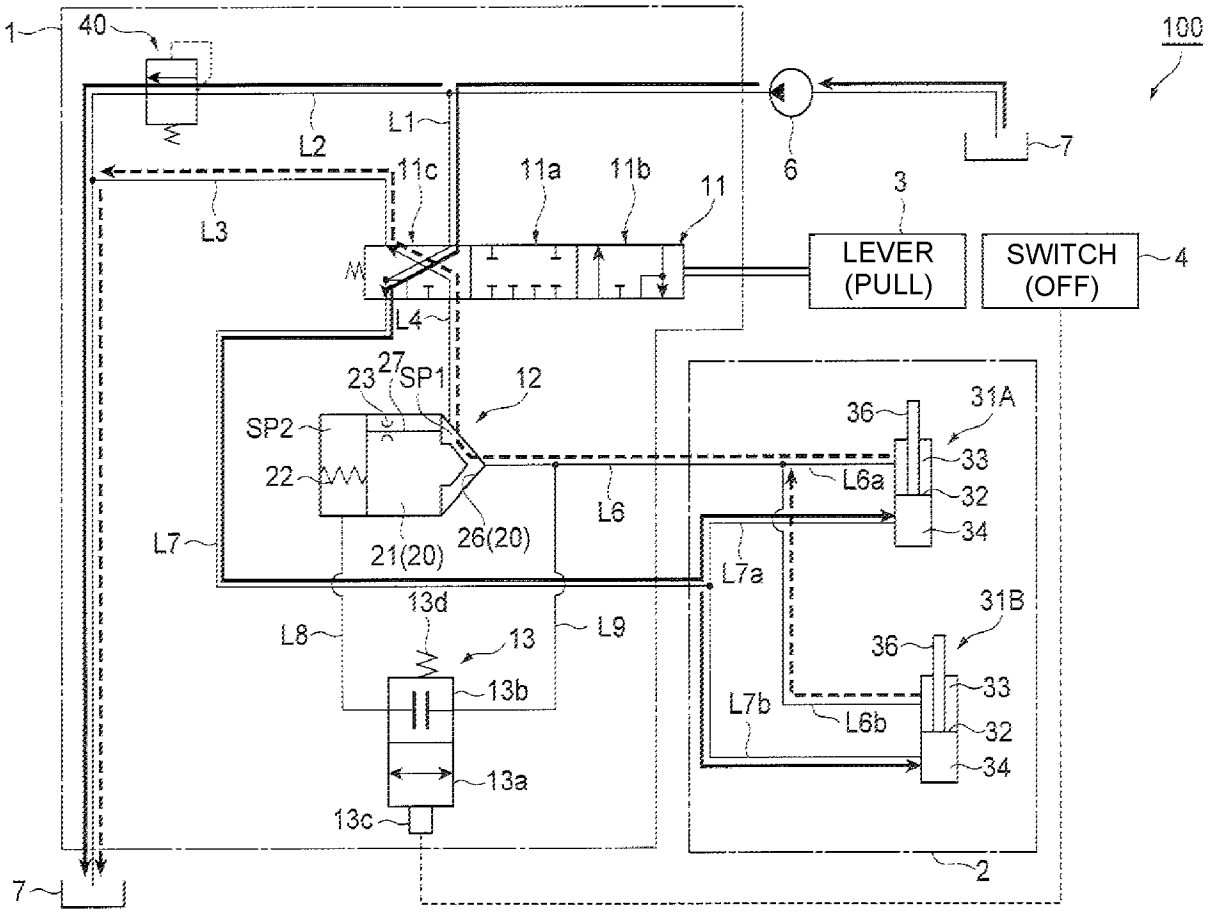
FIG. 4 is a diagram showing an operation of the hydraulic drive apparatus when the lever is pulled while the switch is off.
Figure 5:
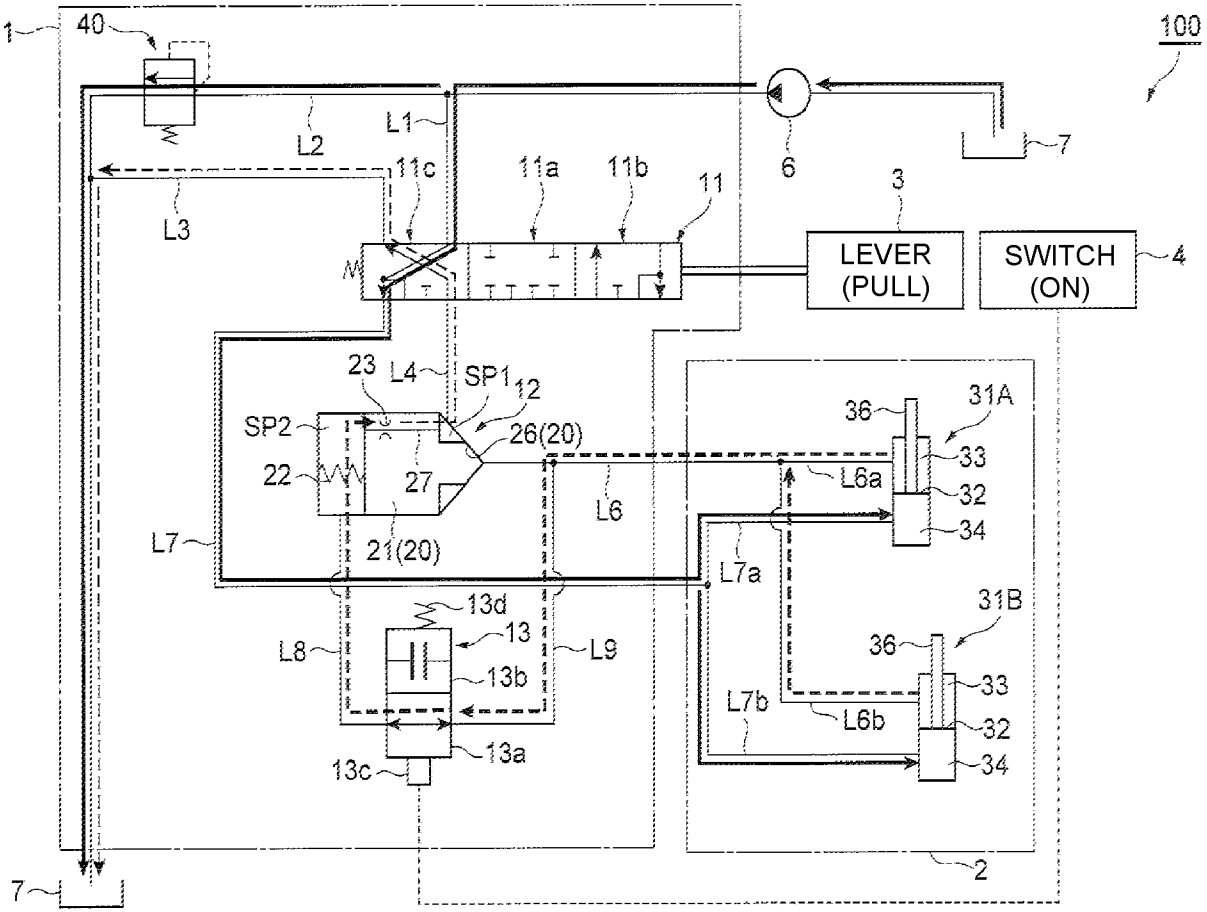

With reference to FIGS. 2 through to 5, the operations of the hydraulic drive apparatus 100 of the present embodiment will be described in more detail. FIG. 2 is a diagram showing an operation of the hydraulic drive apparatus 100 when the lever 3 is pushed while the switch 4 is off. FIG. 3 is a diagram showing an operation of the hydraulic drive apparatus 100 when the lever 3 is pushed while the switch 4 is on. FIG. 4 is a diagram showing an operation of the hydraulic drive apparatus 100 when the lever 3 is pulled while the switch 4 is off. FIG. 5 is a diagram showing an operation of the hydraulic drive apparatus 100 when the lever 3 is pulled while the switch 4 is on. When the lever 3 is pushed (a first operation), the hydraulic oil flows in a direction to be supplied from the main control valve 11 to the hydraulic pressure chambers 33 of the cylinders 31A and 31B of the cargo-handling device 2. This direction may be referred to as a supplying direction (a first direction). When the lever 3 is pulled (a second operation), the hydraulic oil flows in a direction to be discharged from the hydraulic pressure chambers 33 of the cylinders 31A and 31B of the cargo-handling device 2 to the main control valve 11. This direction may be referred to as a discharging direction (a second direction).

As shown in FIGS. 3 and 5, when the switch 4 is on (a first state), the lock valve 13 is opened. The open-close valve 20 is opened to the flow of the hydraulic oil in the supplying direction to cause the hydraulic oil to bypass the throttle 23. (See FIG. 3.) The rods 36 of the cylinders 31A and 31B of the cargo-handling device 2 are drawn in, and the cargo-handling members are opened to the cargo. The open-close valve 20 is closed against the flow of the hydraulic oil in the discharging direction to cause the hydraulic oil to flow through the throttle 23. (See FIG. 5.) The rods 36 of the cylinders 31A and 31B of the cargo-handling device 2 are pushed out with a restriction on the operating speeds of the rods 36, and the cargo-handling members are closed against the cargo.

As shown in FIGS. 2 and 4, when the switch 4 is off (a second state), the lock valve 13 is closed. The open-close valve 20 is closed against the flow of the hydraulic oil in the supplying direction to block the flow of the hydraulic oil toward the cargo-handling device 2. (See FIG. 2.) The operation of the cargo-handling device 2 is thereby restricted. The open-close valve 20 is opened to the flow of the hydraulic oil in the discharging direction from the cargo-handling device 2 to cause the hydraulic oil to bypass the throttle 23. (See FIG. 4.) The rods 36 of the cylinders 31A and 31B of the cargo-handling device 2 are thereby pushed out without the restriction on the operating speeds of the rods 36, and the cargo-handling members are closed against the cargo.

The operation shown in FIG. 2 will be described below. In FIG. 2, the solid arrow indicates the flow of the hydraulic oil supplied from the hydraulic pump 6. Pushing the lever 3 sets the main control valve 11 in the second position 11*b*. The hydraulic oil supplied from the hydraulic pump 6 flows through the line L1, the main control valve 11, the flow passage 27, and the line L8 to the lock valve 13. Since the switch 4 is off, the attraction force of the solenoid 13*c* is not generated, and the lock valve 13 is set in the second position 13*b*. The hydraulic oil from the line L8 is blocked by the lock valve 13. As a result, the pressure in the spring chamber SP2 of the logic valve 12 is increased, and the poppet 21 closes the line L6, i.e., the open-close valve 20 is closed. The part of the flow route of the hydraulic oil flowing toward the cargo-handling device 2 is blocked, and the operations of the cylinders 31A and 31B of the cargo-handling device 2 are restricted. It is noted that the pressure of the hydraulic oil supplied from the hydraulic pump 6 exceeds the relief pressure of the relief valve 40, and thereby the hydraulic oil supplied from the hydraulic pump 6 flows through the line L2 to be discharged to the tank 7.

The operation shown in FIG. 3 will be described below. The lever 3 is pushed, and the main control valve 11 is set in the second position 11*b*. The hydraulic oil supplied from the hydraulic pump 6 flows through the line L1, the main control valve 11, the flow passage 27, and the line L8 to the lock valve 13. Since the switch 4 is on, the attraction force of the solenoid 13*c* is generated, and the lock valve 13 is set in the first position 13*a*. The hydraulic oil from the line L8 is thereby supplied through the lock valve 13 and the line L9 to the line L6. The flow rate of the hydraulic oil is reduced by flowing through the throttle 23, and the pressure in the spring chamber SP2 of the logic valve 12 is decreased. The pressure in the communicating chamber SP1 becomes greater than the pressure in the spring chamber SP2. As a result, the poppet 21 is moved to the spring chamber SP2 and the line L6 is connected with the communicating chamber SP1, i.e., the open-close valve 20 is opened. The hydraulic oil from the line L4 bypasses the throttle 23 and the lock valve 13, and flows through the line L6 to the hydraulic pressure chambers 33 of the cylinders 31A and 31B of the cargo-handling device 2. As indicated by the dashed arrow, the hydraulic oil discharged from the hydraulic pressure chambers 34 of the cylinders 31A and 31B flows through the line L7, the main control valve 11, the line L3, and the line L2 to be discharged to the tank 7. The rods 36 of the cylinders 31A and 31B of the cargo-handling device 2 are drawn in and the cargo-handling members are opened to the cargo. It is noted that part of the hydraulic oil supplied from the hydraulic pump 6 flows through the relief valve 40 and the line L2 to be discharged to the tank 7.

The operation shown in FIG. 4 will be described below. The lever 3 is pulled, and the main control valve 11 is set in the third position 11*c*. The hydraulic oil supplied from the hydraulic pump 6 flows through the line L1, the main control valve 11, and the line L7, to the hydraulic pressure chambers 34 of the cylinders 31A and 31B of the cargo-handling device 2. Since the switch 4 is off, the attraction force of the solenoid 13*c* is not generated, and the lock valve 13 is set in the second position 13*b*. The hydraulic oil discharged from the hydraulic pressure chambers 33 of the cylinders 31A and 31B flows through the line L6 to the logic valve 12. The hydraulic pressure of the hydraulic oil discharged from the hydraulic pressure chambers 33 of the cylinders 31A and 31B exceeds the elastic force of the spring 22 of the logic valve 12, thereby moving the poppet 21 to the spring chamber SP2. The line L6 communicates with the communicating chamber SP1, i.e., the open-close valve 20 is opened. As indicated by the dashed arrow, the hydraulic oil discharged from the hydraulic pressure chambers 33 of the cylinders 31A and 31B flows through the line L6, the logic valve 12, the line L4, the main control valve 11, the line L3, and the line L2 to be discharged to the tank 7. The rods 36 of the cylinders 31A and 31B of the cargo-handling device 2 are pushed out and the cargo-handling members closed against the cargo. Since the hydraulic oil discharged from the cargo-handling device 2 bypasses the lock valve 13 and the throttle 23 and flows through the communicating chamber SP1 of the logic valve 12, the flow rate is not reduced by the throttle 23. As a result, the cylinders 31A and 31B operate without a restriction on the operating speed. It is noted that part of the hydraulic oil supplied from the hydraulic pump 6 flows through the relief valve 40 and the line L2 to be discharged to the tank 7.

The operation shown in FIG. 5 will be described below. The lever 3 is pulled, and the main control valve 11 is set in the third position 11*c*. The hydraulic oil supplied from the hydraulic pump 6 flows through the line L1, the main control valve 11, and the line L7, to the hydraulic pressure chambers 34 of the cylinders 31A and 31B of the cargo-handling device 2. Since the switch 4 is on, the attraction force of the solenoid 13*c* is generated, and the lock valve 13 is set in the first position 13*a*. The hydraulic oil from the line L6 thereby flows through the line L6, the lock valve 13, and the line L8, to the spring chamber SP2 of the logic valve 12. Owing to the pressure in the spring chamber SP2 and the elastic force of the spring 22, the poppet 21 maintains the line L6 closed, i.e. the open-close valve 20 is kept closed. As indicated by the dashed arrow, the hydraulic oil discharged from the hydraulic pressure chambers 33 of the cylinders 31A and 31B flows through the line L6, the line L9, the lock valve 13, the line L8, the flow passage 27, the line L4, the main control valve 11, the line L3, and the line L2 to be discharged to the tank 7. The rods 36 of the cylinders 31A and 31B of the cargo-handling device 2 are pushed out, and the cargo-handling members are closed against the cargo. The hydraulic oil from the cargo-handling device 2 flows through the logic valve 12 in a state where the flow rate is reduced by the throttle 23. As a result, the cylinders 31A and 31B operate with the restriction on the operating speeds. Although the cargo handling is allowed when the lever 3 is pulled while the switch 4 is on, the cargo-handling operating speed is slower than when the lever 3 is pulled while the switch 4 is off. It is noted that part of the hydraulic oil supplied from the hydraulic pump 6 flows through the relief valve 40 and the line L2 to be discharged to the tank 7.

The operational effects of the hydraulic drive apparatus 100 for the industrial vehicle according to the embodiment of the present disclosure will be described below.

The hydraulic drive apparatus 100 for the industrial vehicle includes the lock valve 13 that is disposed in the part of the flow route of the hydraulic oil between the main control valve 11 and the cargo-handling device 2. The lock valve 13 is opened and closed by the switch 4. When the switch 4 is on (the first state), the lock valve 13 is opened. The cargo handling operated by pushing the lever 3 (the first operation) is allowed when the switch 4 is on. Therefore, the interlocking feature performed by the switching operation of the switch is provided to the cargo handling operated by pushing the lever 3. When the lever 3 is pushed while the switch 4 is on, the open-close valve 20 opens to the flow of the hydraulic oil in the supplying direction (the first direction) to cause the hydraulic oil to bypass the throttle 23. In other words, the cargo handling operated by pushing the lever 3 is not restricted by the throttle 23. When the lever 3 is pulled (the second operation) while the switch 4 is on, the open-close valve 20 is closed against the flow of the hydraulic oil in the discharging direction (the second direction) to cause the hydraulic oil to flow through the throttle 23. Therefore, the throttle 23 restricts the cargo handling operated by pulling the lever 3 (the second operation) while the switch 4 is on. In other words, when the switch 4 is on, i.e., when the interlocking is released, the cargo handling operated by pulling the lever 3 is restricted. In the conventional art, a driver may keep the switch 4 on all the time by, for example, fixing the switch 4 with an adhesive tape, in order to avoid the restriction placed on the cargo handling operated by pulling the lever 3 since the restriction causes a delay in the operation. In contrast to this, according to the present embodiment, a driver turns the switch 4 on only when the driver pushes the lever 3. In other words, the driver releases the interlocking only when the driver pushes the lever 3. This allows the interlocking feature of the apparatus to be more secured. In this way, when the interlocking feature is provided for the cargo handling performed by one of the operations of the lever 3 while the switch 4 is turned to the interlock releasing side, the restriction is placed on the cargo handling performed by the other of the operations of the lever 3.

When the switch 4 is off, the lock valve 13 blocks the flow route. While the switch 4 is off, the cargo handling operated by pushing the lever 3 is not allowed. That is, the cargo handling operated by pushing the lever 3 is unallowable unless the switch 4 is turned on. In this way, the interlock effectively functions against the pushing operation of the lever 3.

The open-close valve 20 is provided by the logic valve 12 that includes the throttle 23. The logic valve 12 functions as both the open-close valve 20 and the throttle 23 in a single component.

The present invention is not limited to the embodiment described above.

Figure 6:
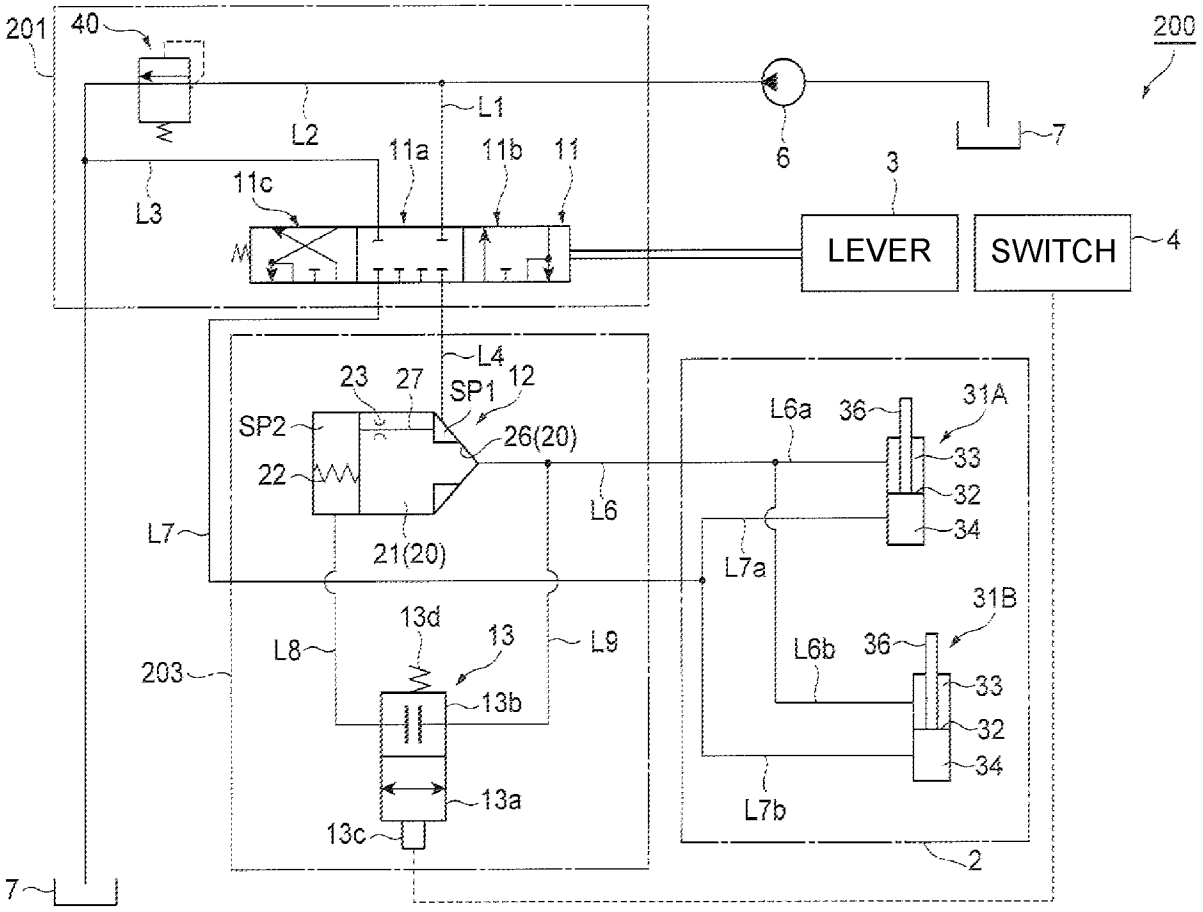
FIG. 6 is a schematic diagram showing the hydraulic drive apparatus for the industrial vehicle according to a modified embodiment of the present disclosure.

A hydraulic drive apparatus 200 as shown in FIG. 6 may be used. The hydraulic drive apparatus 200 includes an external second hydraulic control device 203, in addition to a first hydraulic control device 201. The second hydraulic control device 203 includes a logic valve 12 and a lock valve 13. The hydraulic control device that includes a main control valve 11 may be provided separately from the hydraulic control device that includes the logic valve 12 and the lock valve 13.

In the above embodiment, the open-close valve 20 is provided by the logic valve 12 that includes the throttle 23. However, the hydraulic-oil circuit may be configure to have the throttle 23 provided separately from the open-close valve 20.

What is claimed is:

1. A hydraulic drive apparatus for an industrial vehicle, the hydraulic drive apparatus driven by a pressure of hydraulic oil supplied from a hydraulic pump, comprising:

a cargo-handling device that handles an object;

a hydraulic control device that controls the pressure of the hydraulic oil supplied to the cargo-handling device;

a cargo-handling-device operating member that is used to operate the cargo-handling device; and a switching member that switches operations of the cargo-handling device, wherein the hydraulic control device includes:

a main control valve that switches connection states in a flow route according to an operation of the cargo-handling-device operating member;

a lock valve that is provided in a part of the flow route of the hydraulic oil between the main control valve and the cargo-handling device, and is opened and closed by the switching member;

a throttle that is provided in the part of the flow route of the hydraulic oil between the main control valve and the cargo-handling device, and reduces a flow rate of the hydraulic oil; and an open-close valve that is provided to cause the hydraulic oil to bypass the lock valve and the throttle, the hydraulic oil flows in a first direction when a first operation of the cargo-handling-device operating member is performed, and the hydraulic oil flows in a second direction when a second operation of the cargo-handling-device operating member is performed, and when the switching member is in a first state, the lock valve is opened, the open-close valve is opened to the flow of the hydraulic oil in the first direction the allow hydraulic oil to bypass the throttle, and the open-close valve is closed against the flow of the hydraulic oil in the second direction to allow the hydraulic oil to flow through the throttle.

2. The hydraulic drive apparatus for the industrial vehicle according to claim 1, wherein the part of the flow route of the hydraulic oil between the main control valve and the cargo-handling device includes lines connected to each other through the lock valve, and when the switching member is in a second state, the lock valve is closed, and the lines connected to each other through the lock valve are disconnected.

3. The hydraulic drive apparatus for the industrial vehicle according to claim 1, wherein the open-close valve is provided by a logic valve that includes the throttle.

4. A hydraulic drive apparatus for an industrial vehicle, the hydraulic drive apparatus driven by a pressure of hydraulic oil supplied from a hydraulic pump, comprising:

a pair of hydraulic cylinders configured to handle an object;

a hydraulic control device that controls the pressure of the hydraulic oil supplied to the pair of hydraulic cylinders;

a lever configured to operate the pair of hydraulic cylinders; and a switching member that switches operations of the pair of hydraulic cylinders, wherein the hydraulic control device includes:

a main control valve that switches connection states in a flow route according to an operation of the lever;

a lock valve that is provided in a part of the flow route of the hydraulic oil between the main control valve and the pair of hydraulic cylinders, and is opened and closed by the switching member;

a throttle that is provided in the part of the flow route of the hydraulic oil between the main control valve and the pair of hydraulic cylinders, and reduces a flow rate of the hydraulic oil; and an open-close valve that is provided to cause the hydraulic oil to bypass the lock valve and the throttle, the hydraulic oil flows in a first direction when a first operation of the lever is performed, and the hydraulic oil flows in a second direction when a second operation of the lever is performed, and when the switching member is in a first state, the lock valve is opened, the open-close valve is opened to the flow of the hydraulic oil in the first direction to allow the hydraulic oil to bypass the throttle, and the open-close valve is closed against the flow of the hydraulic oil in the second direction to allow the hydraulic oil to flow through the throttle.

* * * * *